US006976753B2

(12) United States Patent
Kuwabara et al.

(10) Patent No.: US 6,976,753 B2
(45) Date of Patent: Dec. 20, 2005

(54) LIQUID CONTAINER AND INK JET PRINTING APPARATUS

(75) Inventors: Nobuyuki Kuwabara, Tokyo (JP); Hiroyuki Ishinaga, Tokyo (JP); Tetsuya Ohashi, Chiba (JP); Ryoji Inoue, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 10/726,502

(22) Filed: Dec. 4, 2003

(65) Prior Publication Data

US 2004/0135854 A1 Jul. 15, 2004

(30) Foreign Application Priority Data

Dec. 10, 1905 (JP) ..... 2002-358183

(51) Int. Cl.[7] ..... B41J 2/175
(52) U.S. Cl. ..... 347/86; 347/87
(58) Field of Search ..... 347/85, 86, 87; 141/2, 18

(56) References Cited

U.S. PATENT DOCUMENTS

| | | | | |
|---|---|---|---|---|
| 5,409,134 | A | 4/1995 | Cowger et al. | 222/1 |
| 5,481,289 | A | 1/1996 | Arashima et al. | 347/93 |
| 5,600,358 | A | 2/1997 | Baldwin et al. | 347/87 |
| 5,953,030 | A | 9/1999 | Ishinaga et al. | 347/86 |
| 6,168,266 | B1 | 1/2001 | Ishinaga et al. | 347/86 |
| 6,247,806 | B1 | 6/2001 | Matsumoto et al. | 347/87 |
| 6,302,532 | B1 | 10/2001 | Ishinaga et al. | 347/86 |
| 6,332,674 | B1 | 12/2001 | Kamiyama et al. | 347/86 |
| 6,345,888 | B1 | 2/2002 | Matsumoto et al. | 347/86 |
| 6,428,154 | B1 | 8/2002 | Kamiyama et al. | 347/86 |
| 6,431,698 | B1 * | 8/2002 | Mou et al. | 347/86 |
| 6,450,631 | B1 | 9/2002 | Hayashi et al. | 347/86 |
| 6,490,792 | B1 | 12/2002 | Ishinaga et al. | 29/890.1 |
| 6,575,567 | B2 | 6/2003 | Matsumoto et al. | 347/85 |
| 6,692,119 | B2 * | 2/2004 | Yu et al. | 347/86 |
| 6,773,099 | B2 * | 8/2004 | Inoue et al. | 347/86 |
| 6,854,836 | B2 * | 2/2005 | Ishinaga et al. | 347/85 |
| 2003/0035036 | A1 | 2/2003 | Ogura et al. | 347/86 |
| 2003/0067518 | A1 | 4/2003 | Ogura et al. | 347/86 |
| 2003/0067520 | A1 | 4/2003 | Inoue et al. | 347/86 |
| 2003/0122909 | A1 | 7/2003 | Ogura et al. | 347/86 |
| 2004/0061748 | A1 | 4/2004 | Kuwabara | 347/85 |

FOREIGN PATENT DOCUMENTS

| | | |
|---|---|---|
| JP | 6-183023 | 7/1994 |
| JP | 7-125240 | 5/1995 |
| JP | 7-125241 | 5/1995 |

* cited by examiner

*Primary Examiner*—Anh T.N. Vo
(74) *Attorney, Agent, or Firm*—Fitzpatrick, Cella, Harper & Scinto

(57) ABSTRACT

A liquid container has a movable member which defines a liquid containing space and which is displaced as the liquid is supplied, a valve for allowing a gas to be introduced into the containing space from the outside and for preventing the liquid from being extracted from the containing space to the outside, and an introduction channel for coupling the valve and the containing space to guide the introduced gas into the containing space. An intake port of the introduction channel located on the containing space side is positioned in an upper part of the containing space in an orientation in use. A negative pressure is kept substantially constant to consume the liquid completely. Since the air introduction for keeping the negative pressure at an adequate value is carried out in a region in a gaseous phase in the container, no leakage of ink occurs, and air is reliably introduced.

11 Claims, 11 Drawing Sheets

LIQUID CONTAINER AND INK JET PRINTING APPARATUS

This application claims priority from Japanese Patent Application No. 2002-358183 filed Dec. 10, 2002, which is incorporated hereinto by reference.

BACKGROUND OF THE INVENTION

1. Field of the Invention

The present invention relates to a liquid container for supplying a liquid such as ink to a pen or printing head as a printing section or to a liquid using apparatus such as a printing apparatus, for example, in an efficient and stable manner, and to an ink jet printing apparatus utilizing the liquid container.

2. Description of the Related Art

Ink jet printing apparatuses that form an image on a printing medium by applying ink that is a liquid to the printing medium using a liquid consuming or using apparatus such as an ink jet printing head include apparatus that form an image by ejecting ink while moving a printing head relative to a printing medium and apparatus that form an image by ejecting ink while moving a printing medium relative to a fixed printing head conversely.

Methods of supplying ink to a printing head used in such an ink jet printing apparatus include a method referred to as on-carriage method in which an ink tank is integrally or separably mounted to a printing head that is carried by a carriage to be moved back and forth (main scanning) and in which ink is directly supplied from the ink tank to the printing head. There is another method referred to as tube supply method in which an ink tank is fixed in a region of a printing apparatus other than a carriage as a body separate from a printing head carried by the carriage and in which ink is supplied by coupling the ink tank and the printing head through a flexible tube. The method includes a configuration in which a second ink tank to serve as an intermediate tank (sub-tank) between an ink tank (main tank) and a printing head is mounted on the printing head or a carriage and in which ink is directly supplied from the second ink tank to the printing head.

According to those methods, an ink tank to supply ink to a printing head directly is provided with a mechanism for generating an adequate negative pressure in a range in which the negative pressure is in equilibrium with a pressure in the printing head to hold meniscuses formed at an ink ejecting section thereof to prevent the ink from leaking from the ink ejecting section satisfactorily and in which an ink ejecting operation of the printing head can be performed.

In a negative pressure generating mechanism of this type, a porous member such as a sponge that is impregnated with ink to be held thereby is contained in an ink tank, and an adequate negative pressure is generated by an ink holding capacity of the same.

In another mechanism, a bag-shaped member formed from a material such as rubber having an elastic force and generating a tension in the direction of increasing the volume thereof is charged with ink as it is, and the tension generated by the bag-shaped member exerts a negative pressure to the in therein.

In still another mechanism, a bag-shaped member is formed using a flexible film, and a spring for urging the film in the direction of increasing the volume of the bag-shaped member is bonded to the interior or exterior of the same to generate a negative pressure.

In any of the above mechanisms, however, the negative pressure tends to increase as the amount of ink in the ink tank decreases, and it becomes impossible to supply ink to a printing head stably when the level of the negative pressure exceeds a predetermined value. This results in a problem in that the ink tank becomes unusable before the ink is completely used up.

Several mechanisms have been proposed as follows to prevent magnitude of a negative pressure being too much greater than the predetermined level.

For example, Japanese Patent Application Laid-open No. 7-125240 (1995) and Japanese Patent Application Laid-open No. 7-125241 (1995) have disclosed mechanisms in which a hydrophobic film and a tubular vent port are provided in a tank, and a spherical body is disposed in the tube to introduce air into the tank when a negative pressure therein increases. That is, those publications have disclosed mechanisms which have a tubular vent port (boss) that establishes communication between the outside and inside of a container and in which spherical body having an outer diameter smaller than an inner diameter of the boss is attached to a plurality of projecting ribs provided on an inner wall of the boss to form a substantially annular orifice with the spherical body and the boss. The size of such an orifice is chosen such that a small amount of ink is kept in the orifice as a liquid seal because of the capillarity of ink. The orifice is configured such that a negative pressure in the container overcomes the capillarity of ink to disable the liquid seal when it nearly reaches the limit of an operating range of the printing head. At the time, the atmosphere enters into the container in the form of bubbles which results in causing a reduction of an inner pressure of over a certain level.

Japanese Patent Application Laid-open No. 6-183023 (1994) has disclosed a mechanism in which a plate-like member having a hole and a plate having a protrusion are provided in a face-to-face relationship in an ink bag constituted by a flexible sheet with a spring member disposed between the plates and in which the protrusion enters the hole when an internal negative pressure exceeds a predetermined value to separate the plate having the hole and the flexible sheet from each other, thereby introducing air in the tank. In this mechanism, the plate having the hole and the flexible sheet come into tight contact with each other after air is introduced, and leakage of ink is prevented by an ability for holding ink meniscuses or a liquid seal formed between those elements.

However, those methods require a plurality of parts in a region where air is introduced, and the structure of such a region has therefore become complicated.

When a pressure in a container T having a certain amount of air introduced therein becomes extremely high as a result of an ambient change (a reduction of the atmospheric pressure or a temperature rise) as shown in FIG. 1A, ink is pushed out from the container as shown in FIG. 1B, which can result in leakage of ink through an ink ejection port N or a vent hole A when the container is used in an ink jet printing head. When a liquid is contained in a bag-shaped member constituted by a flexible sheet, although expected is a certain degree of buffering effect that moderates an increase of a pressure therein by accommodating expansion of air which results in a pressure reduction, such an effect is limited.

Referring to Japanese Patent Application Laid-open No. 7-125241 (1995) or Japanese Patent Application Laid-open No.6-183023(1994) in this connection, a method is disclosed in which a channel in the form of a maze is provided at the bottom of a tank and in which an ink overflow resulting from an increase in the internal pressure is allowed to move to that section. Although this method is effective, the formation of the maze-like channel results in a more complicated structure, and a certain degree of ink evaporation is unavoidable because the other end of the maze-like channel is always in communication with the atmosphere.

Further, in those examples of the related art, there is provided an opening section for directly introducing the atmosphere into an ink tank. As a result, the quantity of gases in the ink tank becomes relatively great in a region in the ink tank where ink is nearly used up depending on the size and position of the opening section, which can result in incomplete holding of meniscuses at the ink ejection port or opening section when the negative pressure is eliminated as a result of introduction of the atmosphere and can therefore lead to leakage of ink or incomplete introduction of the atmosphere.

Particularly, in the case that the opening section (a vent) is configured to have a contact with the ink stored therein directly, there arises a necessity to control a dimension and a shape of the opening area of the opening section precisely in order to avoid an ink leakage from the opening section.

In addition, breakage of a liquid seal can occur because of various conditions such as a difference between air pressures inside and outside the container, a temperature rise of drop, a shock or drop that occurs when the ink tank is handled alone, and acceleration that occurs during main scanning according to the serial printing method, in particular. This results in a problem in that air can be introduced or ink can leak out conversely even when a pressure in the container has not reached a predetermined value. Further, such conditions can vary depending on the designs of the printing head and ink tank or physical properties of ink, and a problem arises also in that designing must be adequately carried out in accordance with the shape and dimensions of the opening section and the basic configuration of the negative pressure generating mechanism depending on each mode of use.

The technique disclosed in the Japanese Patent Application Laid-open No. 6-183023 (1994) employs a structure in which air is introduced through a microscopic gap between a thin plate-like member and a flexible sheet. This has resulted in another problem in that a negative pressure becomes unstable when air is introduced because the force for causing separation as described is changed by a capillary force that is generated when a liquid enters the gap.

SUMMARY OF THE INVENTION

From the above, the inventors first considered that an effective solution to the above-described problems is to avoid providing the opening section for introducing air into the liquid container in a region that can come into contact with the liquid, if circumstances allow. From this, the inventors further found that there is no need for strict limitations on the area and the shape of the opening and freedom in designing the same is therefore increased where the opening section is not in contact with the liquid, and the finding led to this invention.

The invention has been made taking the above-described problems into consideration, and the invention provides a liquid container (such as an ink tank) in which introduction of air into the liquid container for coping with an increase in a negative pressure in the container is performed in an appropriate position in the container to achieve higher reliability in terms of stabilization of the negative pressure, to prevent leakage of a liquid even at an abrupt ambient change, and to prevent wasteful consumption of the liquid eventually, the invention also provides a liquid-consuming apparatus (such as an ink jet printing apparatus) utilizing the liquid container.

In a first aspect of the present invention, there is provided a liquid container comprising:

a movable member which defines a space for containing liquid and which is displaced as the liquid is supplied to the outside;

a liquid containing chamber having a liquid supply port for supplying the contained liquid to the outside;

a one-way valve for allowing gas to be introduced into the containing space from the outside and for preventing the liquid from being delivered from the containing space to the outside; and an introduction channel for coupling the one-way valve and the containing space to guide the introduced gas into the containing space, wherein an intake port of the introduction channel located on the side of the containing space is positioned in an upper part of the containing space in an orientation in use.

In a second aspect of the present invention, there is provided a liquid-using apparatus which can be connected to a liquid container as claimed in claim 1 and which uses a liquid supplied from the containing space.

In a third aspect of the present invention, there is provided an ink jet printing apparatus, wherein the above liquid and a printing head for ejecting ink supplied from the container are used to perform printing.

In a fourth aspect of the present invention, there is provided an ink jet cartridge comprising the above liquid container and a printing head for ejecting ink supplied from the container.

Incidentally, in the present specification, the wording "printing" means not only a condition of forming significant information such as characters and drawings, but also a condition of forming images, designs, patterns and the like on printing medium widely or a condition of processing the printing media, regardless of significance or unmeaning or of being actualized in such manner that a man can be perceptive through visual perception.

Further, the wording "printing medium" means not only a paper used in a conventional printing apparatus but also everything capable of accepting inks, such as fabrics, plastic films, metal plates, glasses, ceramics, wood and leathers, and in the following, will be also represented by a "sheet" or simply by "paper".

Still further, the wording "ink" should be interpreted in a broad sense as well as a definition of the above "printing" and thus the ink, by being applied on the printing media, shall mean a liquid to be used for forming images, designs, patterns and the like, processing the printing medium or processing inks (for example, coagulation or encapsulation of coloring materials in the inks to be applied to the printing media).

The above and other objects, effects, features and advantages of the present invention will become more apparent from the following description of embodiments thereof taken in conjunction with the accompanying drawings.

BREIF DESCRIPTION OF THE DRAWINGS

DETAILED DESCRIPTION OF PREFERRED EMBODIMENTS

The present invention will now be described in detail with reference to the drawings.

Various embodiments of the invention applied to an ink jet printing apparatus will be described below. Specifically, a liquid container contains ink to be supplied to an ink jet printing head, and the term "ink" may therefore be substituted for the term "liquid". Specifically, the present invention is effective for an ink containing color material. More specifically, the present invention is preferable for an ink containing pigment to ensure more excellent ink supply characteristic.

(First Embodiment)

Figure 2:
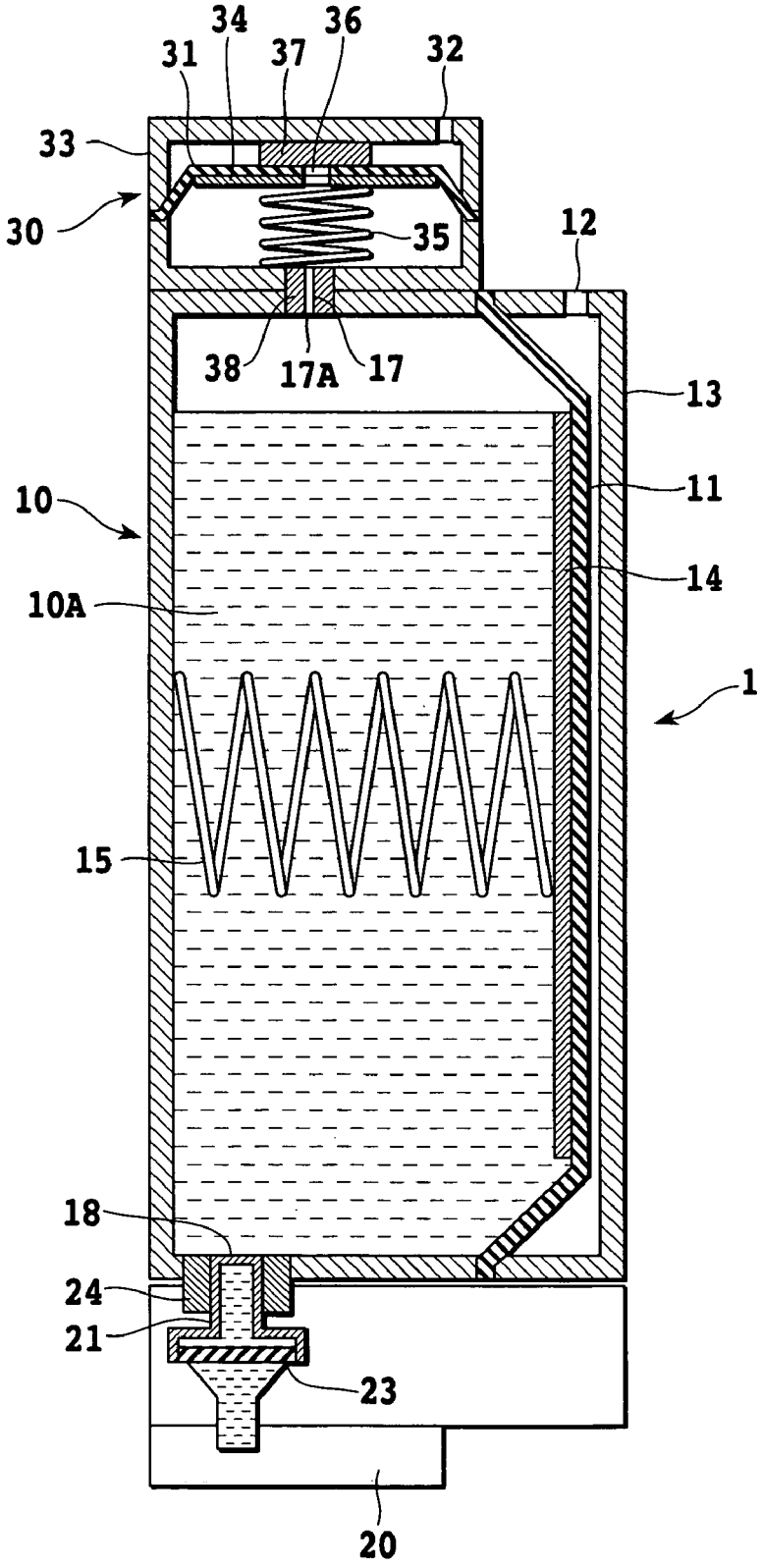
FIG. 2 is a schematic sectional view showing an example of an ink container which is a liquid container used in a first embodiment of the invention and onto which an ink jet printing head is integrally mounted.

FIG. 2 shows a liquid container in another embodiment of the invention, the liquid container having an ink jet printing head 20 (hereinafter simply referred to as "printing head) integrally mounted thereto. The liquid container (hereinafter also referred to as "ink container") is generally constituted by two chambers, i.e., an ink containing chamber 10 in which an ink containing space 10A is defined and a valve chamber 30 positioned at an upper part of the ink containing chamber in a state of use as shown in this figure, and the interiors of the two chambers are in communication with each other through an air introduction channel 17. Ink to be ejected from the printing head 20 is charged in the ink containing chamber 10 and is supplied to the printing head 20. Here, the air introduction channel 17 in the state of use is positioned at an upper part of the ink containing chamber, whereby an air supply opening 17A for discharging air is also positioned upper part of the ink containing chamber.

The ejection of ink from the printing head 20 is not limited to any particular method and, for example, thermal energy generated by an electrothermal transducer may be used as energy for ejecting ink. In this case, film boiling is caused in ink by head generated by the electrothermal transducer, and ink may be ejected through ink ejection ports by foaming energy at that time.

A movable member 11 that is a movable section is disposed in a part of the ink containing chamber 10, and a space for containing ink is defined between this section and an outer casing 13. A space outside the ink containing space 10A as viewed from the movable member 11 or a space on the right-hand side of the movable member 11 in FIG. 2 is exposed to the atmosphere through an atmosphere communication port 12 such that it has a pressure equal to the atmospheric pressure. Further, a substantially sealed space is formed in the ink containing space 10A except for an ink supply port 18 provided at the bottom thereof and the air introduction channel 17 between the valve chamber 30 and the space.

The outer casing 13 defines the ink containing space 10A and also serves as a shell for protecting the movable member 11 from an external force. The movable member 11 of the present embodiment is constituted by a deformable flexible film (sheet member) whose configuration in a central section thereof is regulated by a support plate 14 that is a support member in the form of a flat plate and which is deformable in a peripheral section thereof. The movable member 11 has a convex configuration in the central section and has a trapezoidal side configuration. As will be described later, the movable member 11 is deformed in accordance with changes in the amount of ink in the ink containing space 10A and fluctuations of a pressure in the same. In such cases, the peripheral section of the movable member 11 is expanded and contracted or deformed in a good balance, and the central section of the movable member 11 undergoes parallel displacement in the horizontal direction of the figure with a substantially vertical attitude orientation of the same maintained. Since the movable member 11 is thus smoothly deformed (moved), the deformation will cause no shock, and there will be no abnormal pressure fluctuation attributable to shock in the ink containing space.

In the ink containing space 10A, there is provided a spring member 15 in the form of a compression spring for exerting an urging force that urges the movable member 11 to the right in the figure through the support plate 14 to generate a negative pressure within a range in which an ink ejecting operation of the printing head can be performed in equilibrium with an ability for holding meniscus formed at an ink ejecting section of the printing head 20. FIG. 2 shows a state in which the ink containing section 10A is substantially fully charged with ink, and the spring member 15 is compressed to generate an adequate negative pressure in the ink containing space even in this state.

The printing head 20 and the ink containing chamber 10 are coupled by inserting a supply tube 21 provided on the printing head into the ink containing chamber 10. This establishes fluidic coupling between them to allow ink to be supplied to the printing head 20. A sealing member 24 is mounted around the supply tube 21 to ensure sealing between the supply tube 21 and the ink containing chamber 10. A filter 23 is provided in the supply tube 21 to prevent any foreign substance present in supplied ink from flowing into the printing head 20.

The valve chamber 30 will now be described. The interior of the valve chamber 30 is in communication with the ink containing space 10A through the air introduction channel 17. In the present embodiment, the air introduction channel 17 is formed using a pipe made of stainless steel having an inner diameter of 0.2 mm. Further, a sealing member 38 made of rubber is mounted around the stainless steel pipe to improve sealing around the communication channel.

In the valve chamber 30, there is provided a valve closing plate 34 to serve as a valve closing member having an opening section 36 that is an element of the one-way valve and a valve sealing member 37 for sealing the opening section 36. The valve closing plate 34 is bonded to a flexible sheet 31. The opening section 36 extends through the valve closing plate 34 and the flexible sheet 31. A substantially sealing space is maintained also in the valve chamber 30 except for the air introduction channel 17 and the opening section 36. The space above the flexible sheet 31 in the figure is exposed to the atmosphere at the atmosphere communication port 12 to have a pressure equal to the atmospheric pressure. An outer casing 33 of the valve chamber 30 also serves as a shell for protecting the flexible sheet 31 from an external force.

The flexible sheet 31 is also deformable at a peripheral region thereof excluding a central section that is bonded to the valve closing plate. It has a convex configuration in the central section and a substantially trapezoidal side configuration. Such a configuration allows the valve closing plate 34 to be smoothly moved up and down.

In the valve chamber 30, there is provided a valve regulating spring 35 as a valve regulating member for regulating an opening operation of the valve. The valve regulating spring 35 is somewhat compressed to urge the valve closing member 34 upward in the figure utilizing a reaction force against the compression. The function of a valve is achieved by expanding and compressing the valve regulating spring 35 to put the valve sealing member 37 in tight contact with the opening section 36 and to separate them from each other, and a gas is only allowed to be introduced into the valve chamber from the atmosphere communication port 32 through the opening section 36 to provide a one-way valve mechanism.

What is required for the valve sealing member 37 is to seal the opening section 36 with reliability. Specifically, it is required to have a configuration in which at least the part thereof in contact with the opening section 36 securely seals the opening, and there is no particular restriction on the quality of the material as long as tight contact can be achieved. However, since such tight contact is achieved by the expanding force of the valve regulating spring 35, the valve sealing member 37 is more preferably formed from a material that can easily follow the flexible sheet 31 and the valve closing plate 34 moved by the action of the expanding force, i.e., a shrinkable elastic material such as rubber.

An operation of the ink container in the present embodiment having the above configuration will now be described with reference to FIGS. 3A to 3E.

Figure 3A:
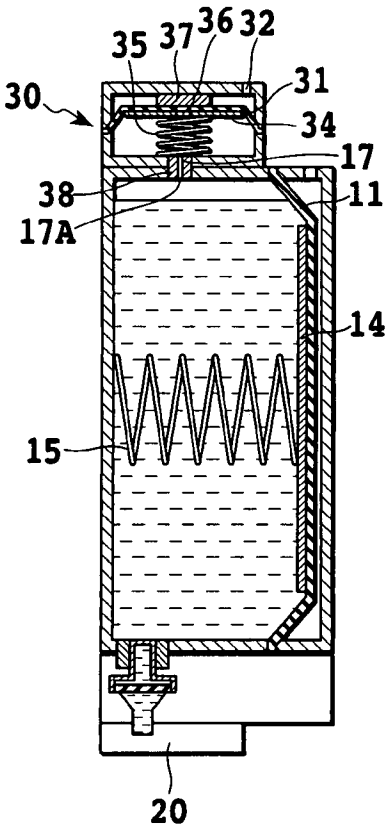
FIGS. 3A to 3E are illustrations for explaining operations of the ink container shown in FIG. 2.

FIG. 3A shows a state of the same in which the ink containing space is sufficiently filled with ink. In this state, since the spring member 15 is compressed, an expanding force F1 (a reaction force originating from the compression) in accordance with the amount of displacement as a result of compression acts on the movable member 11 through the support plate 14. Referring to the direction of the expanding force at this time, it acts rightward in FIG. 3A or the expanding direction of the spring member 15. At this time, a pressure in the ink containing space 10A acts inwardly of the chamber. That is, since the pressure is acting in the direction of drawing the ink into the chamber here, the pressure has a value with a negative sign (negative pressure) according to the above rule for signs on an assumption that the atmospheric pressure is "0", because the pressure acts in the direction.

Since the negative pressure thus acts in the ink containing space, the negative pressure P1 also acts on meniscuses at the ink ejecting nozzles in the printing head 20 to prevent leakage of ink from the ink ejecting port provided on the printing head 20.

In this state, the opening section 36 is sealed by the sealing member 37 in the valve chamber 30. Referring to the pressure in the valve chamber 30, the negative pressure is exerted through the air introduction channel 17 between the chamber and the ink containing space 10A. The expanding force of the valve regulating spring 35 acts in the valve chamber 30. That is, the one-way valve is kept sealed by maintaining a state in which the force provided by the valve regulating spring 35 and the valve closing plate 34 acting against the negative pressure is greater than the internal negative pressure.

The ejection of ink from the printing head 20 proceeds to reduce the amount of ink remaining in the ink containing space 11A, and the negative pressure in the ink containing space 10 increases accordingly.

Figure 3B:
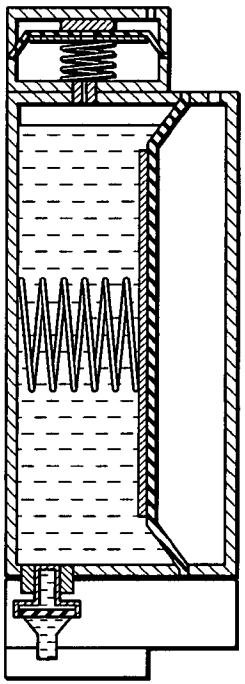
Figure 4:
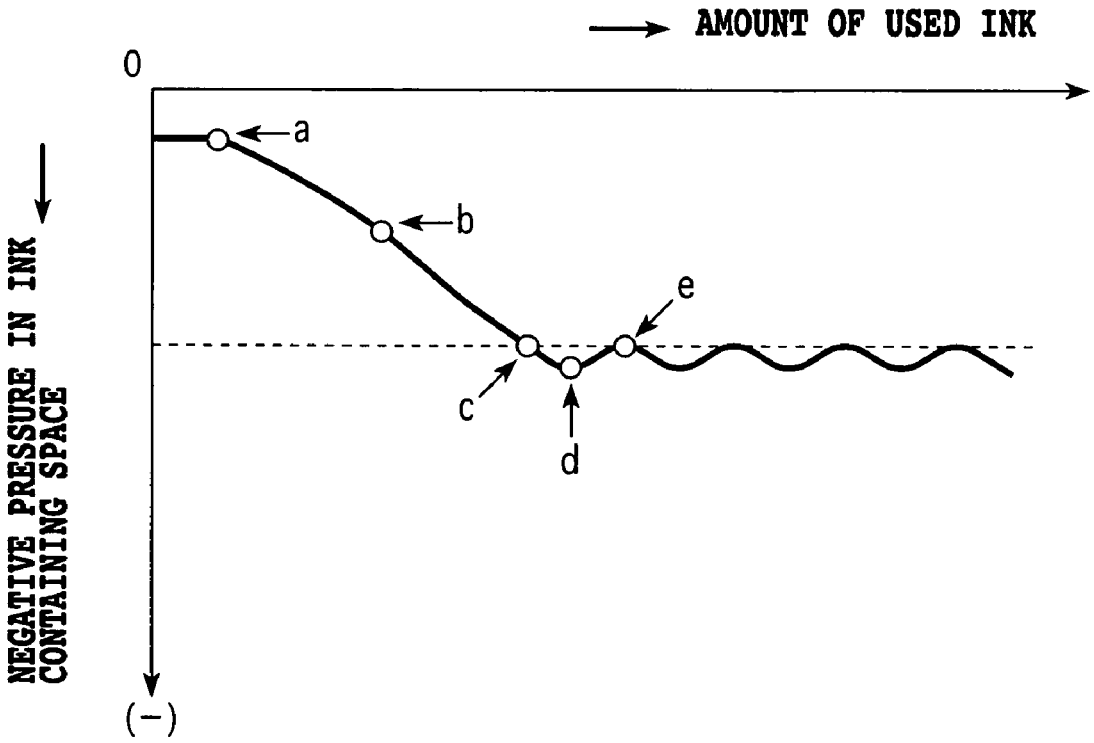
FIG. 4 is an illustration showing a relationship between a negative pressure in an ink containing space of the ink container shown in FIG. 2 and the amount of remaining ink.

FIG. 4 shows a relationship between the negative pressure in the ink containing space 10A and the amount of ink remaining therein or supplied therefrom. When ink consumption continues, a change from the state in FIG. 3A to the state in FIG. 3B occurs. The internal volume of the ink containing space 10A that is a sealed space substantially decreases with the amount of ink, which is accompanied by a leftward movement of the movable member 11 in the figure. The support plate 14 also moves leftward in accordance with the displacement of the movable member 11, and the compression of the spring member 15 also proceeds. The progress of the compression of the spring member 15 means an increase in the expanding force, and the negative pressure also increases from the point a to the point b in FIG. 4.

Figure 3C:
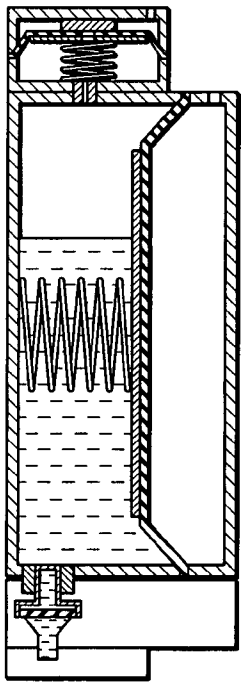

When ink consumption further proceeds from the state in FIG. 3B, the movable member 11 is displaced leftward further to enter the state in FIG. 3C. This further increases the negative pressure in the ink container 10 to change to the point c in FIG. 4. In this state, the negative pressure in the ink container 10 balances the force exerted by the valve regulating member 34 in the valve chamber 30.

Since the state of contact of the valve sealing member 37 achieved by the pressure of the valve regulating spring 35 has not changed up to this point, when ink consumption is continued thereafter to increase the negative pressure further, the force exerted by the valve regulating spring 35 becomes unable to cause the valve sealing member 37 to seal the opening section 36 in the valve chamber 30. This indicates the state shown in FIG. 3D and the change in the negative pressure at the point d in FIG. 4. At the instant when this relationship becomes true, the sealing of the opening section 36 with the sealing member 37 is canceled.

Figure 3D:
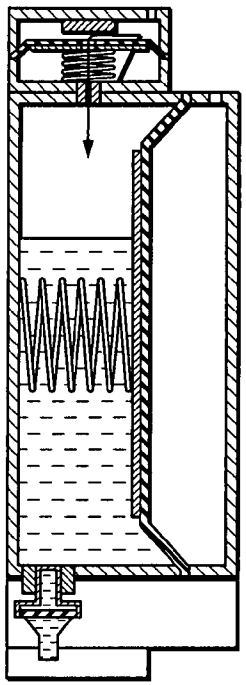

As a result, the atmosphere begins to flow in through the opening section 36 from top to bottom as indicated by the arrow in FIG. 3D, and it is further introduced into the ink containing space 10A through the air introduction channel 17 by the air supply opening 17A disposed bottom end thereof. The introduction of the atmosphere results in an increase in the volumetric capacity of the ink containing space 10A that has been decreasing and simultaneously results in a decrease in the negative pressure that has been increasing, conversely. Based on this, the opening section 36 and the valve sealing member 37 are put in tight contact with each other again in the valve chamber 30 because an extension force of the valve regulating spring 35 overcomes negative pressure. This results in the state shown in FIG. 3E and a change in the negative pressure from the point d to the point e in FIG. 4.

Figure 3E:
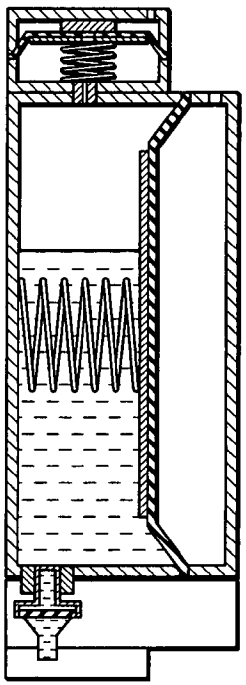

When ink is further consumed thereafter, the state in FIG. 3D and the state in FIG. 3E alternate; there are very small changes in the negative pressure as shown at the point e and later; and ink is consumed with the negative pressure kept at a substantially constant value. That is, since the state in FIG. 3D and the state in FIG. 3E are thus repeated even when ink consumption is continued, there is no unnecessary increase in the negative pressure in the ink containing space 10A after a certain amount of ink is consumed, which makes it possible to use up the ink in the ink containing space 10A while maintaining a stable ejecting condition.

As described, since the valve chamber 30 is located higher than the ink containing chamber 10, the opening section of the air introduction channel for allowing air to flow from the valve chamber to the ink containing chamber resides higher than the ink containing chamber. Thus, a flow of air does not pass through the ink and occurs only in a region occupied by air. This ensures that the intake of air for adjusting the negative pressure is performed with stability. Since no air bubble is generated in the ink, it is possible to prevent problems such as transportation of air bubbles into the printing head 20.

(Second Embodiment)

Although the first embodiment has a configuration in which the valve chamber is located higher than the ink containing chamber in the position or orientation in use, instead of relying upon the positional relationship between those elements, the same purpose can be achieved by appropriately configuring the air introduction channel.

Figure 1B:
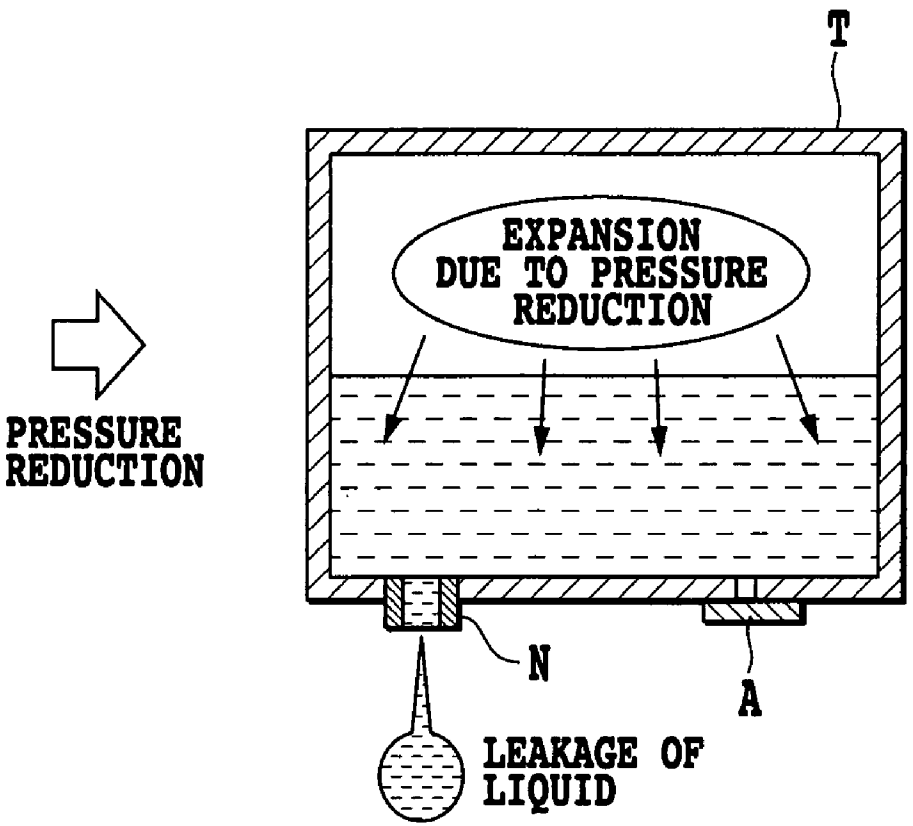
FIGS. 1A and 1B are illustrations for explaining problems with a liquid container according to the related art into which outside air is introduced to moderate an increase of a negative pressure that occurs as a result of consumption of a liquid (ink)
Figure 1A:
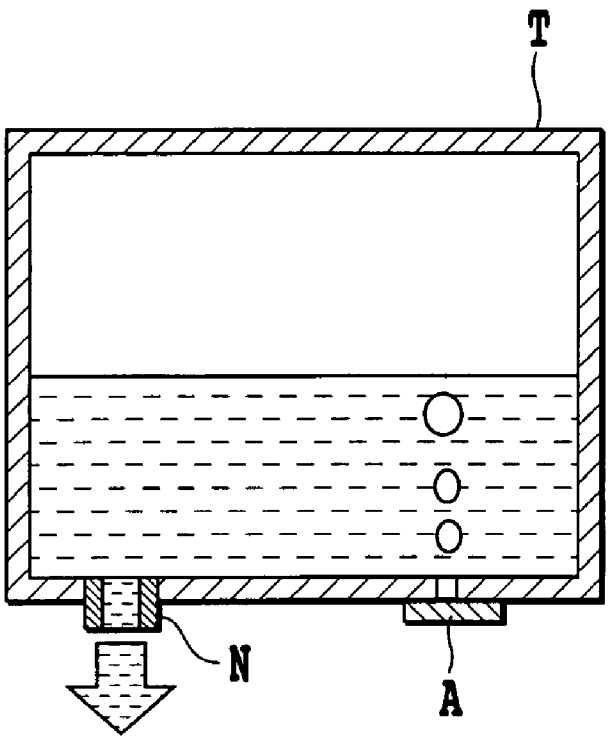
Figure 5:
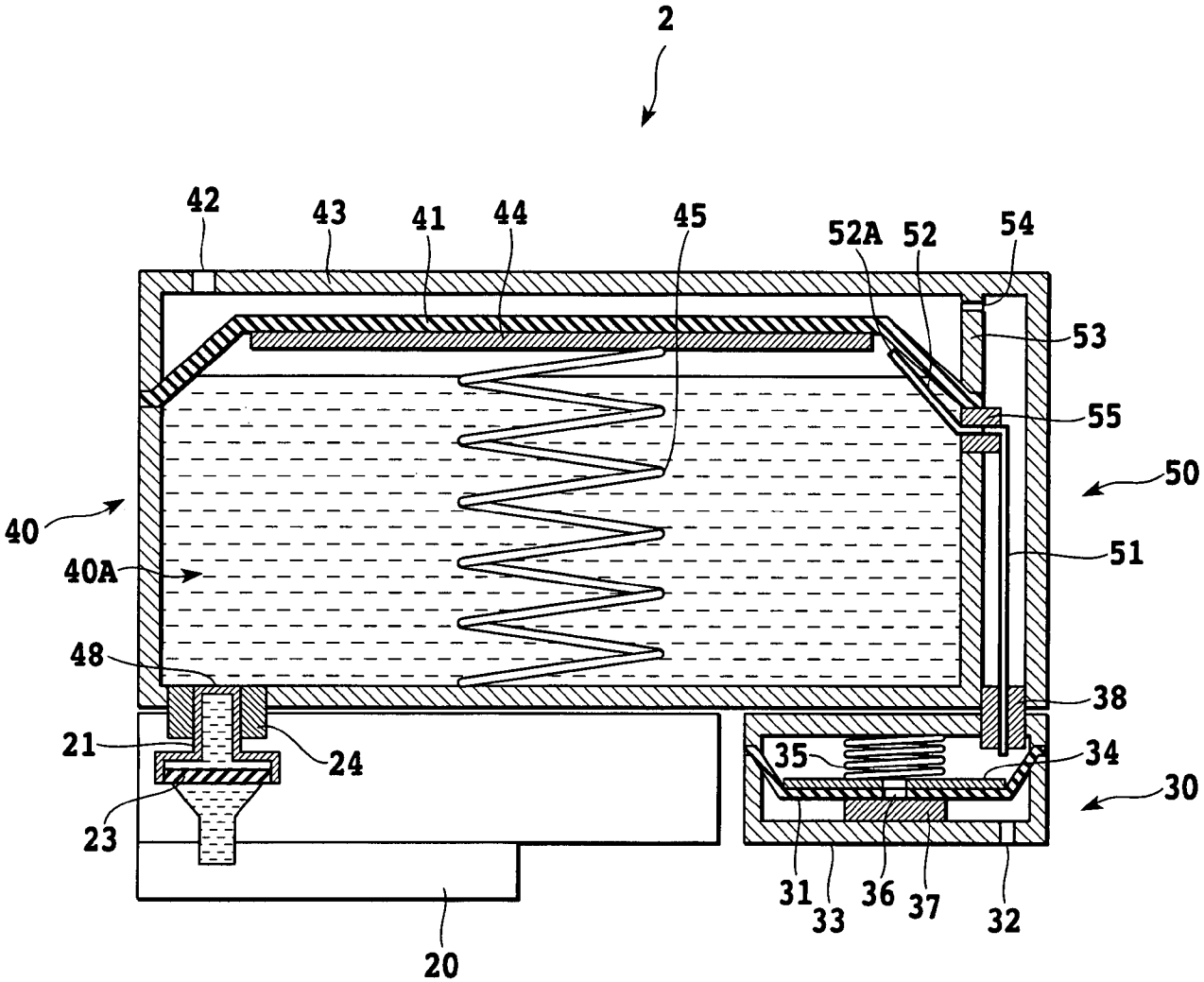
FIG. 5 is a schematic sectional view showing an example of an ink container which is a liquid container used in a second embodiment of the invention and onto which an ink jet printing head is integrally mounted.

FIG. 5 shows a liquid container used in a second embodiment of the invention. A printing head 20 similar to that in the first embodiment is integrally mounted to a liquid container 2. The liquid container (hereinafter also referred to as "ink container") is generally comprised of three chambers, i.e., an ink containing chamber 40 in which an ink containing space 40A is defined, a valve chamber 30, and an air introduction channel containing chamber 50. The interiors of the ink containing chamber 40 and the valve chamber 30 are in communication with each other through an air introduction channel 51 provided in the air introduction channel containing chamber 50. Ink to be ejected from the printing head 20 is charged in the ink containing chamber 40A and is supplied to the printing head 20. The valve chamber used in the present embodiment will be referred to by the same reference numeral as used in FIG. 1 because it is similar to that shown in FIG. 2 according to the first embodiment and is different only in the mounting position and direction relative to the ink containing chamber.

A movable member 41 which is a movable part is disposed in a part of the ink containing chamber 40, and a space for containing ink is defined between the same part and an outer casing 43. The space that is located outside an ink containing space 40A in the direction of the movable member 41, i.e., the space above the movable member 41 in FIG. 5 is exposed to the atmosphere at an atmosphere communication port 42 to be put under a pressure equal to the atmospheric pressure. Further, the interior of the ink containing space 40A forms a substantially enclosed space except for an ink supply port 48 that is provided on the bottom thereof and a part thereof communicating to an air introduction channel 51 provided between the space and the valve chamber 30.

The outer casing 43 defines the above-described ink containing space 40A and also serves as a shell for protecting the movable member 41 from an external force. The movable member 41 of the present embodiment is constituted by a deformable flexible film (sheet member) similar to that in the first embodiment. The configuration of the member in a central section thereof is regulated by a support plate 44 which is a support member in the form of a flat plate, and a peripheral section of the same is deformable. The movable member 41 has a convex configuration in the central section and a substantially trapezoidal side configuration. As will be described later, the movable member 41 is deformed in accordance with changes in the amount of ink in the ink containing space 40A and fluctuations in a pressure in the same. In such cases, the peripheral section of the movable member 41 is expanded and contracted or deformed in a good balance, and the central section of the movable member 41 undergoes parallel displacement upward and downward in the figure with a substantially horizontal position thereof maintained. Since the movable member 41 is thus smoothly deformed (moved), the deformation will cause no shock, and there will be no abnormal pressure fluctuation attributable to shock in the ink containing space.

In the ink containing space 40A, there is provided a spring member 45 in the form of a compression spring for exerting a force that urges the movable member 41 upward in the figure through the support plate 44 to generate a negative pressure within a range in which an ink ejection operation of the printing head can be performed in equilibrium with an ability for holding meniscuses formed at an ink ejecting section of the printing head 20. FIG. 5 shows a state in which the ink containing space 40A is substantially fully charged with ink, and the spring member 45 is compressed to generate an adequate negative pressure in the ink containing space even in this state. The ink containing chamber 40A is not fully charged with ink, and it is charged such that a small amount of air is left therein. Thus, when the internal volume of the ink containing space 40A is expanded or reduced due to a change in the pressure therein caused by a change in the ambient temperature or barometric pressure around the liquid container 2, such a configuration allows the expansion or reduction to be absorbed using the expanding or contracting force of the spring member 45 acting on the region of air that expands or contracts in a larger amount.

The printing head 20 and the ink containing chamber 40 are coupled in the same manner as in the first embodiment.

The valve chamber 30 will now be described. The interior of the valve chamber 30 is in communication with the ink containing space 40A through the air introduction channel 51. In the present embodiment, a pipe made of stainless steel having an inner diameter of 1 mm is used as a member to form the air introduction channel 151. Further, a seal member 38 made of rubber is attached around the pipe made of stainless steel in order to improve sealing around the outer circumference of the air introduction channel 51.

In the valve chamber 30, there is provided a valve closing plate 34 constituting a valve closing member having an opening section 36 and a valve seal member 37 for sealing the opening section 36 which are constituent elements of a one-way valve. Further, the valve closing plate 34 is bonded with a flexible sheet 31, and the opening section 36 extends through the valve closing plate 34 and the flexible sheet 31. A substantially enclosed space is maintained also in the valve chamber 30 except for a part thereof in communication with the air introduction channel 51 and the opening section 36. The space located under the flexible sheet 31 in the figure is exposed to the atmosphere through an atmosphere communication port 32 to be put under a pressure equal to the atmospheric pressure. An outer casing 33 of the valve chamber 30 also serves as a shell for protecting the flexible sheet 31 from an external force.

The flexible sheet 31 is also deformable in a peripheral section thereof other than a section in the middle thereof that is bonded with the valve closing plate, and it has a convex configuration in the central section and a substantially trapezoidal side configuration. The valve closing plate 34 is allowed to move up and down smoothly by employing such a configuration.

A valve regulating spring 35 is provided in the valve chamber 30 as a valve regulating member for regulating an opening operation of the valve. A configuration is employed again in which the valve regulating spring 35 is slightly compressed to urge the valve closing member 34 downward in the figure by a reaction force against the compression. The valve seal member 37 is put in tight contact with the opening section 36 and is spaced from the same by the expansion and contraction of the valve regulating spring 35 to cause the member to function as a valve. It also serves as a one-way valve mechanism which allows a gas to be introduced from the atmosphere communication port 32 into the valve chamber through the opening section 36.

Communication is provided between the ink containing space 40A and the space in the valve chamber 30 through the air introduction channel 51 as thus described. A tube 52 is further connected to the other end of the air introduction channel 51, and it penetrates through a partition wall 53 to be inserted into the ink containing space 40A. A seal member 55 made of resin is tightly fitted to the neighborhood of the connection between the air introduction channel 51 and the tube 52 to cover them, and the part of the partition wall 53 where the air introduction channel and the tube are inserted is also kept sealed by the seal member 55. Further, an atmosphere communication port 54 is provided on the partition wall 53 to put the region outside the air introduction channel 51 in the air introduction channel containing chamber 50 under a pressure equal to the atmospheric pressure.

Since the tube 52 is thus connected to the air introduction channel 51, air introduced from the valve chamber 30 flows through the air introduction channel 51, and flows into the ink containing space 40A from an opening section at the other end of the tube 52, and the section serves as an intake port of the containing space. A soft and flexible silicone tube is used as the tube 52, and the intake port 52A is fixed to the inside of the sheet of the movable member 41 (inside the ink containing space).

Thus, the tube 52 follows up the movement of the movable member 41, and the intake port 52A is located in an upper part of the ink containing space. Further, in the present embodiment, since a small amount of air is left in the upper part even when ink is charged to a maximum level, the intake port 52A can be kept untouched by ink when the liquid container 2 is in a normal still standing state. Even when the liquid container 2 as a whole is inclined to put the intake port 52A in contact with ink, ink is unlikely to enter the tube 52 and the air introduction channel 51 because of the force of ink meniscuses. Even in the case of a change in the temperature or barometric pressure in the neighborhood of the liquid container 2, ink will not enter the tube because the a gas is more apt to expand than a liquid and because the other end of the air introduction channel 51 is connected to the valve chamber 30 that is normally an enclosed space.

Operations of the ink container of the present embodiment having the configuration in FIG. 5 will be described with reference to FIGS. 6A to 6C.

When ink in the ink containing space 40A decreases as ink is ejected from the printing head 20, the internal volume of the ink containing space 40A decreases. As a result, the movable member 41 along with the support plate 44 moves downward in the figure to be deformed, and the spring 45 is also compressed simultaneously. The compression of the spring increases a negative pressure in the ink containing space 40A. The effect of the negative pressure is extended even into the valve chamber 30 through the tube 52 and the air introduction channel 51. When the reaction force against the compression of the valve regulating spring 35 in the valve chamber is stronger than the negative pressure, the opening section 36 is sealed by the valve seal member 37.

Figure 6A:
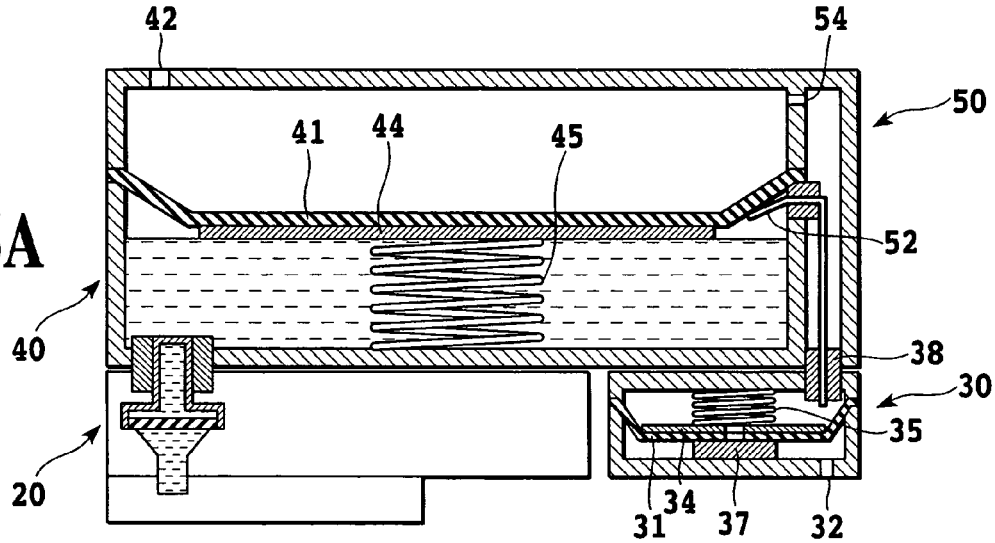
FIGS. 6A to 6C are illustrations for explaining operations of the ink container shown in FIG. 5.

FIG. 6A shows a state resulting from a change from FIG. 5 that occurs as the process proceeds. FIG. 6A shows a state in which the opening section 36 is sealed because the force originating from the valve regulating spring 35 is relatively great even though the negative pressure in the ink containing space 40A has increased by a downward movement of the support plate 44 as a result of ink consumption and in which those forces are in equilibrium with each other.

Figure 6B:
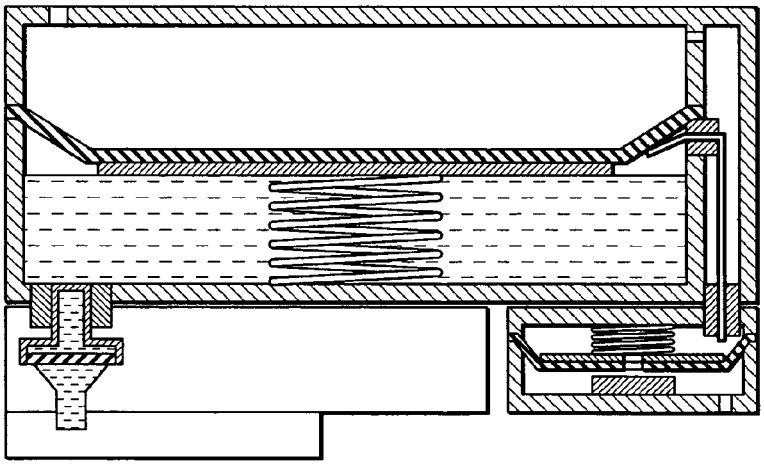
Figure 6C:
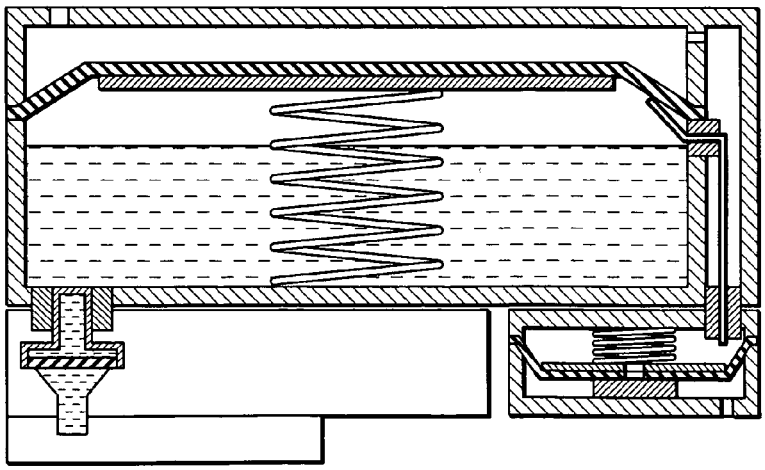

Therefore, when ink consumption is further continued from this point, the negative pressure in the ink containing space 40A increases at that instant to a level at which the opening section can no longer be kept sealed by the valve regulating spring 35 in the valve chamber 30, and the valve closing member 34 and the flexible sheet 31 are displaced upward as shown in FIG. 6B. As a result, the opening section 36 is put in communication with air, and air enters the valve chamber through the section. The air which has thus entered flows through the air introduction channel 51 and the tube 52 to be introduced into the ink containing chamber 40A from the intake port 52A.

Since the introduction of air increases the internal volume of the ink containing space 40A, the support plate 44 is urged upward by the expanding force of the spring member 45, and the movable member 41 which has been deformed is restored to the initial state. This operation decreases the negative pressure in the ink containing space 40A. As a result, the valve regulating spring 35 in the valve chamber is also expanded by the reaction force against compression to move the valve closing member 34 downward and to thereby restore the deformed flexible sheet 31 to the initial state, and the opening section 36 is sealed by the seal member 37 again. FIG. 6C shows such a state.

When ink is further consumed in this state, the process approaches the state shown in FIG. 6A from which the above-described operations are repeated. The operations are repeated until the ink in the ink containing space 40A runs out, which allows the ink to be used up.

During the series of operations, the intake port 52A that is an air outlet of the tube 52 is always kept untouched by the ink that is a liquid. That is, the contained ink is not delivered outward other than being supplied to the printing head 20.

(Third Embodiment)

Figure 7:
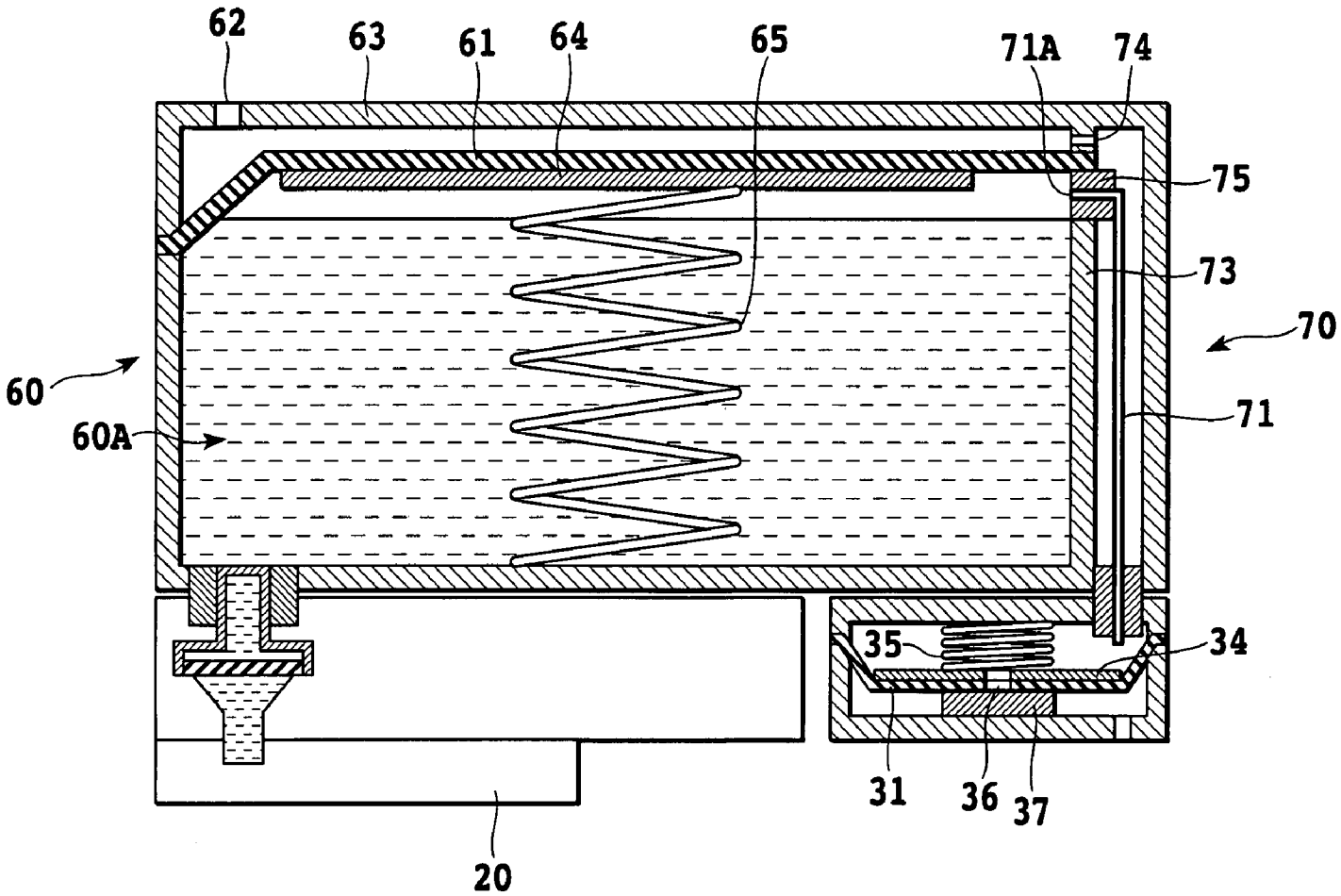
FIG. 7 is a schematic sectional view showing an example of an ink container which is a liquid container used in a third embodiment of the invention and onto which an ink jet printing head is integrally mounted.

FIG. 7 shows a liquid container used in a third embodiment of the invention. In the second embodiment shown in FIG. 5, the movable member for defining the ink containing space is formed with a side section substantially in the form of an isosceles trapezoid and is supported at a peripheral section of the same. A movable member 61 of the present embodiment is shaped to have a flat continuous portion in a top surface thereof, and an end of the portion is supported by a partition wall 73 in an upper part of a container 60. Further, a part of the movable member 61 on the right side thereof in the figure is not expanded and contracted or deformed by employing a support plate 64 configured to extend toward the partition wall 73.

An air introduction channel 71 is configured such that it is in communication with the upper part of the containing space in a part thereof in the vicinity of the position where the movable member is supported, and no tube is connected unlike the second embodiment. That is, an intake port is constituted by an opening section 71A of the air introduction channel 71 on the side of the channel facing an ink containing space 60A. Preferably, the opening section 71A is made substantially flush with a surface of the partition wall 73 on the side of the ink containing space 60A or positioned such that it slightly protrudes into the ink containing space 60A from that surface. The air introduction channel 71 extends through a part of the partition wall 73. A seal member 75 made of rubber is disposed in that part to cover the neighborhood of the air introduction channel 71 in tight contact therewith and to keep the gap between the partition wall 73 and the same sealed. Further, an atmosphere communication port 74 is provided in a part of the partition wall 73 located above the position where the movable member is supported, thereby putting a region of an air introduction channel containing chamber 70 located outside the air introduction channel 71 under a pressure equal to the atmospheric pressure. The air introduction channel 71 used here is a pipe made of stainless steel having an inner diameter of 0.5 mm. The configurations of other parts will not be described because they are similar to those in the second embodiment.

Operations of the ink container of the present embodiment having the configuration in FIG. 7 will be described with reference to FIGS. 8A to 8C.

When ink in the ink containing space 60A decreases as ink is ejected from the printing head 20, the internal volume of the ink containing space 60A decreases. As a result, the movable member 61 along with the support plate 64 is tempted to move downward in the figure to be deformed. However, since the expansion and contraction of the movable member 61 in the present embodiment is substantially limited to a part on the left side thereof shown in FIG. 7, the support plate 64 is displaced in a manner in which it is inclined as shown in FIG. 8A. However, since the spring 65 is compressed even in such a state of displacement, the compression of the spring increases a negative pressure in the ink containing space 60A. The effect of the negative pressure is extended even into the valve chamber 30 through the air introduction channel 71. When the reaction force against the compression of the valve regulating spring 35 in the valve chamber is stronger than the negative pressure, the opening section 36 is sealed by the valve seal member 37.

Figure 8A:
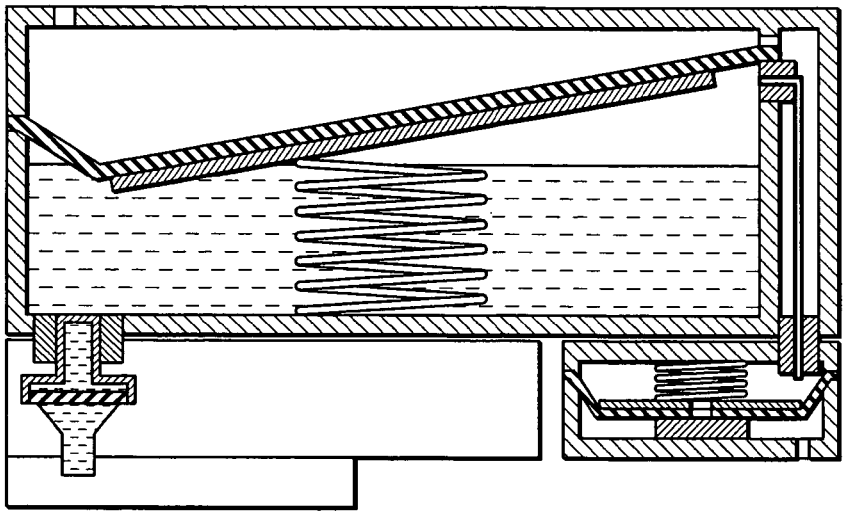
FIGS. 8A to 8C are illustrations for explaining operations of the ink container shown in FIG. 7.

FIG. 8A shows a state resulting from a change from FIG. 7 that occurs as the process proceeds. FIG. 8A shows a state in which the opening section 36 is sealed because the force originating from the valve regulating spring 35 is relatively great even though the negative pressure in the ink containing space 60A has increased by a downward movement of the support plate 64 as a result of ink consumption and in which those forces are in equilibrium with each other.

Figure 8B:
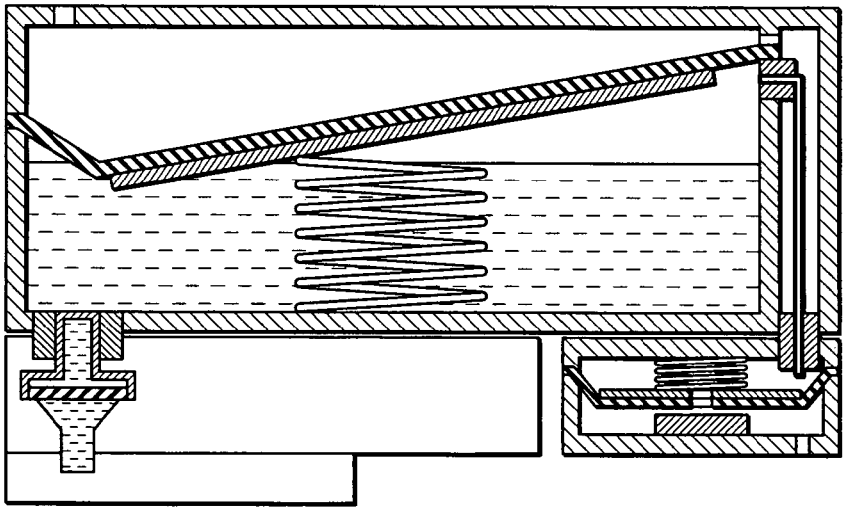
Figure 8C:
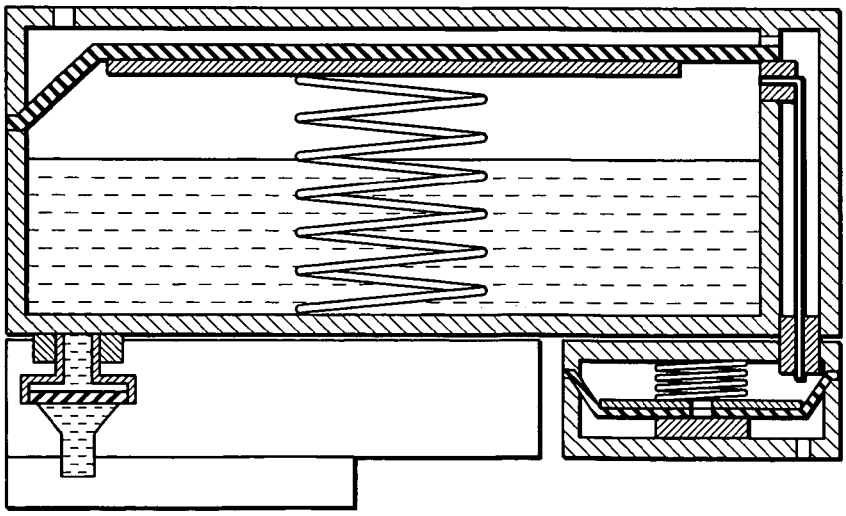

Therefore, when ink consumption is further continued from this point, the negative pressure in the ink containing space 60A increases at that instant to a level at which the opening section can no longer be kept sealed by the valve regulating spring 35 in the valve chamber 30, and the valve closing member 34 and the flexible sheet 31 are displaced upward as shown in FIG. 8B. As a result, the opening section 36 is put in communication with air, and air enters the valve chamber through the section. The air which has thus entered flows through the air introduction channel 71 to be introduced into the ink containing chamber 60A from the intake port 71A.

Since the introduction of air increases the internal volume of the ink containing space 60A, the support plate 64 is urged upward by the expanding force of the spring member 65, and the movable member 61 which has been deformed is restored to the initial state. This operation decreases the negative pressure in the ink containing space 60A. As a result, the valve regulating spring 35 in the valve chamber is also expanded by the reaction force against compression to move the valve closing member 34 downward and to thereby restore the deformed flexible sheet 31 to the initial state, and the opening section 36 is sealed by the seal member 37 again. FIG. 8C shows such a state.

When ink is further consumed in this state, the process approaches the state shown in FIG. 8A from which the above-described operations are repeated. The operations are repeated until the ink in the ink containing space 60A runs out, which allows the ink to be used up.

During the series of operations, the intake port 71A that is an air outlet of the air introduction channel 71 is always kept untouched by the ink that is a liquid. Further, substantially no deformation occurs on the side of the movable member 61 closer to the intake port 71A, the ink can be more effectively prevented from contacting the intake port 71A. That is, the contained ink is not delivered outward other than being supplied to the printing head 20.

(Fourth Embodiment)

Figure 9:
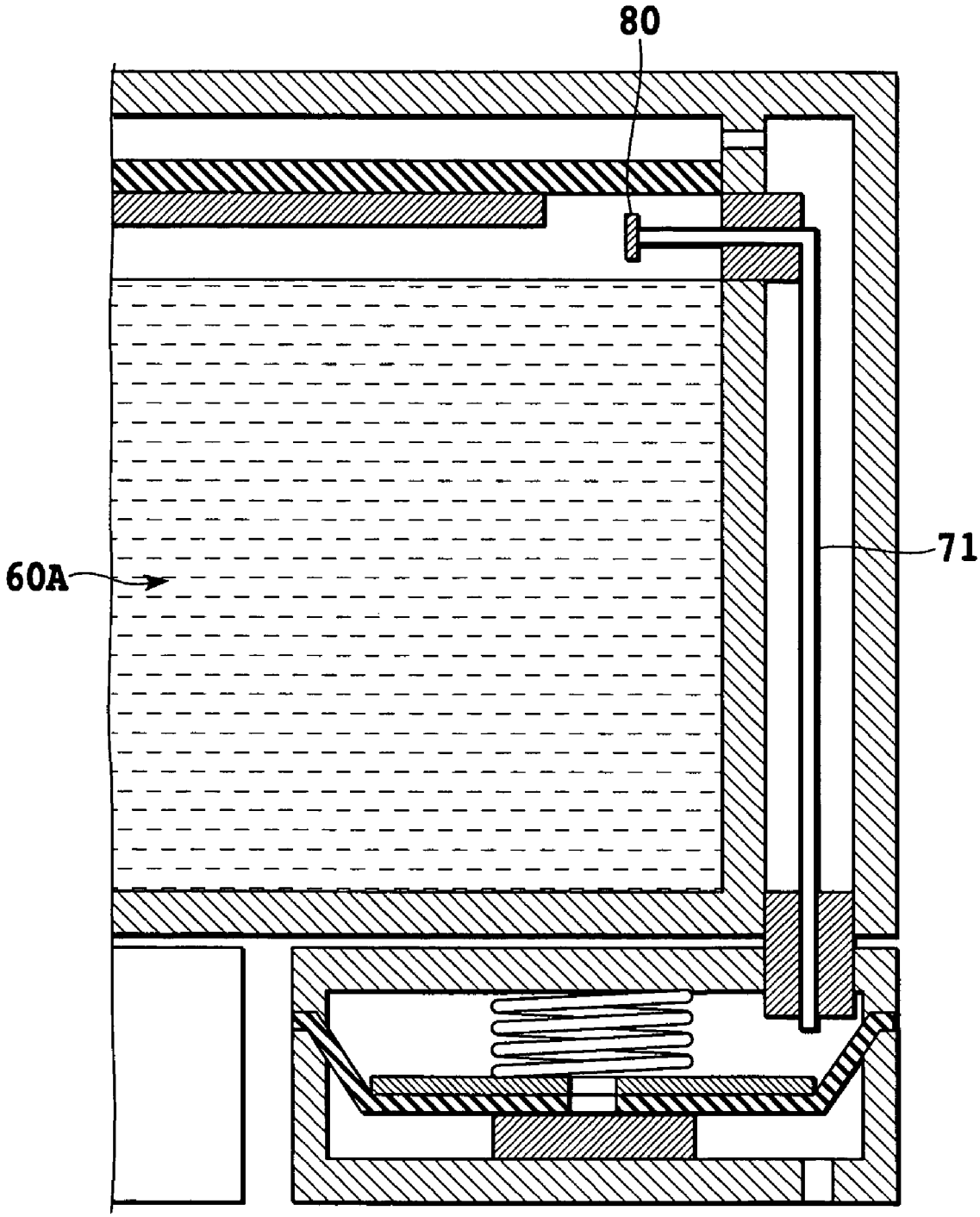
FIG. 9 is a schematic sectional view showing a major part of a liquid container used in a fourth embodiment of the invention.

FIG. 9 shows a fourth embodiment of the invention that is a modification of the third embodiment. FIG. 9 shows a major part of a liquid container and, more particularly, it focuses on a region in which an air introduction channel is provided.

In the present embodiment, a hydrophobic gas-permeable film 80 is attached to the region of an intake port of an air introduction channel 71. The hydrophobic gas-permeable film 80 maybe attached using known techniques such as bonding, crimping and welding. Ink can be more effectively prevented from entering the air introduction channel 71 by attaching the hydrophobic gas-permeable film 80.

Since communication of a liquid between the air introduction channel 71 and the ink containing space 60A can be blocked at the region of the hydrophobic gas-permeable film 80, there is no need for holding meniscuses at the intake port as described above. Therefore, the inner diameter of the air introduction channel 71 can be set at a great value. Specifically, while the inner diameter is 0.5 mm in the above-described third embodiment, the inner diameter is 2 mm in this case. Since ink can be prevented from entering the air introduction channel even when a relatively great inner diameter is thus set, freedom in selecting a material for the air introduction channel and designing the same can be increased.

(Fifth Embodiment)

Figure 10:
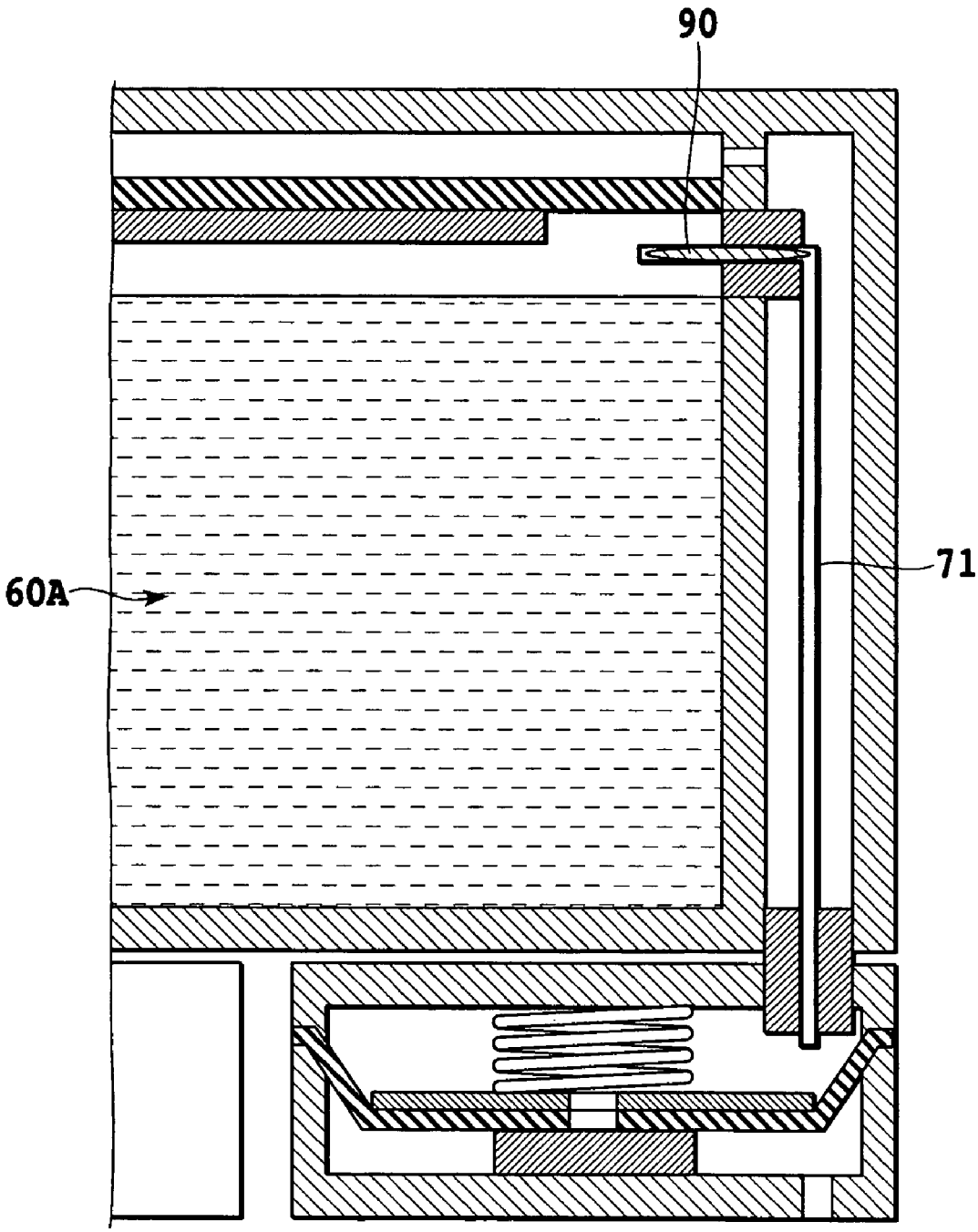
FIG. 10 is a schematic sectional view showing a major part of a liquid container used in a fifth embodiment of the invention.

FIG. 10 shows a fifth embodiment of the invention that is a modification of the third embodiment. FIG. 10 shows a major part of a liquid container and, more particularly, it focuses on a region in which an air introduction channel is provided.

In the present embodiment, a porous member 90 constituted by a foamed porous body made of polyurethane is provided in the vicinity of an intake port inside an air introduction channel 71. The porous member 90 is inserted in the air introduction channel 71 by adapting it to an inner diameter of the channel and forming it in a size and shape that allow the member to be properly fixed in the pipe.

In this configuration, even when ink enters the air introduction channel 71, the ink can be absorbed and held by the porous member 90 to prevent the ink from moving further. It is therefore possible to prevent the movement of the ink toward the valve chamber effectively. Further, there is no need for holding meniscuses at the intake port just as described in the fourth embodiment. Therefore, the inner diameter of the air introduction channel 71 can be set at a great value. Specifically, although the inner diameter is 0.5 mm in the above described third embodiment, ink can be prevented from entering the air introduction channel even when a relatively great inner diameter, e.g., 2 mm is set in the present embodiment, which makes it possible to increase freedom in selecting a material for the air introduction channel and designing the same.

The hydrophobic gas-permeable film described in the fourth embodiment may be provided in the region of the intake port of the present embodiment. In this case, ink can be prevented from entering the air introduction channel with higher reliability.

(Example of Structure of Ink jet Printing Apparatus)

Figure 11:
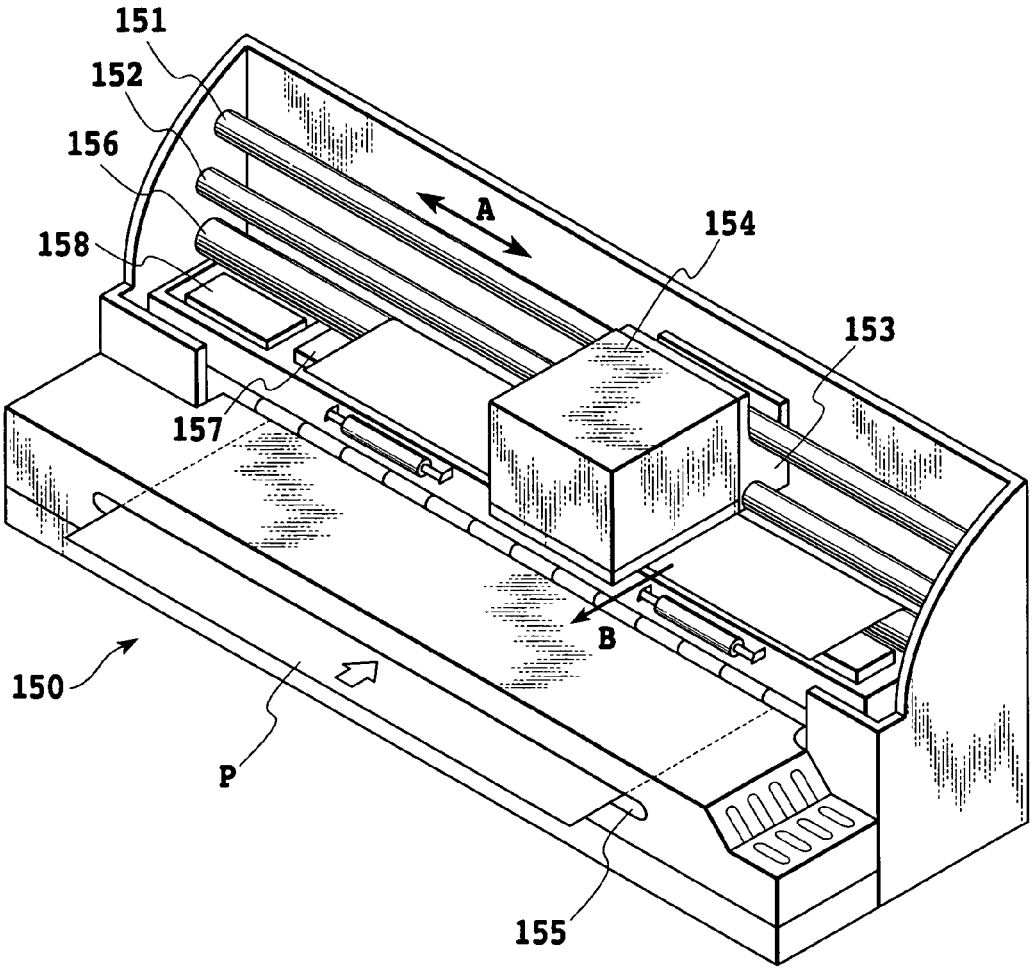
FIG. 11 is a perspective view showing an example of an ink jet printing apparatus to which the present invention is applicable.

FIG. 11 is a perspective view of an example of an ink jet printing apparatus as a liquid-consuming apparatus to which the invention can be applied.

Such a printing apparatus is a serial type ink jet printing apparatus. In the printing apparatus 150 of the present embodiment, a carriage 153 is guided by guide shafts 151 and 152 such that it can be moved in main scanning directions indicated by the arrows A. The carriage 153 is moved back and forth in the main scanning directions by a carriage motor and a driving force transmission mechanism such as a belt for transmitting a driving force of the same motor. The carriage 153 carries an ink jet printing head 20 (not shown in FIG. 11) and an ink tank (ink container) 10 for supplying ink to the ink jet printing head. The ink tank 10 may have any configuration of the above embodiments, and may form an ink jet cartridge in combination with the ink jet printing head. Paper P as a printing medium is inserted into an insertion hole 155 provided at a forward end of the apparatus and is then transported in a sub-scanning direction indicated by the arrow B by a feed roller 156 after its transporting direction is inverted. The printing apparatus 150 sequentially forms images on the paper P by repeating a printing operation for ejecting ink toward a printing area on the paper P while moving the printing head 20 in the main scanning direction and a transporting operation for transporting the paper P in the sub-scanning direction a distance equivalent to a printing width.

The ink jet printing head 20 may utilize thermal energy generated by an electrothermal transducer element as energy for ejecting ink. In this case, film boiling of ink is caused by the heat generated by the electrothermal transducer element, and ink is ejected from an ink ejection port by foaming energy generated at that time. The method of ejecting ink from the ink jet printing head is not limited to such a method utilizing an electrothermal transducer element and, for example, a method may be employed in which ink is ejected utilizing a piezoelectric element.

At the left end of the moving range of the carriage 153 in FIG. 11, there is provided a recovery system unit (recovery process unit) 158 that faces a surface of the ink jet printing head carried by the carriage 153 where an ink ejecting portion are formed. The recovery system unit 158 is equipped with a cap capable of capping the ink ejection portion of the printing head and a suction pump capable of introducing a negative pressure into the cap, and the unit can performs recovery process (also referred to as "suction recovery process") for maintaining a preferable ink ejecting condition of the ink jet printing head by introducing a negative pressure in the cap covering the ink ejection portion to absorb and discharge ink through the ink ejection ports. Further, a recovery process for maintaining a preferable ink ejecting condition of the ink jet printing head by ejecting ink towards the cap (also referred to as "ejection recovery process") may be performed.

(Others)

The spring for generating a negative pressure has been described above as a compression spring provided in the ink containing space. However, the spring may be in the form of a tension spring provided outside the ink containing space. Specifically, a tension spring may be provided between the movable member and the outer casing member that forms the liquid container to achieve the same function. This equally applies to the spring provided in the valve chamber.

While a part of the inner wall of the space forming the ink containing chamber of the ink container may be constituted by a movable member such as a deformable flexible film as in the above-described embodiments, the entire inner wall may alternatively be constituted by such a member as long as the member can be provided in a position higher than the ink level to avoid contact with the ink contained. Instead of providing such a deformable member, a member which is displaced in accordance with the internal volume of the containing space may be provided in a part of the same.

In an embodiment in which the air introduction channel is provided in the containing chamber, it is not essential to leave an open space around the member constituting the air introduction channel. Instead, it is possible to dispose some member in the space, to insert filler therein, or to fill the space with the material of the outer casing. In particular, when the space is filled with the material of the outer casing, the air introduction channel may be provided in the form of a tubular hole cut in the material instead of forming the air introduction channel as a tube that is a separate member. This is advantageous from the view point of assembly and cost because no separate member is required.

The ink container is only required to have a configuration that allows ink to be contained therein, and it is not required to contain ink in the same in advance.

Further, the ink container may be configured so as to be inseparably or separably integrated with a printing head. Alternatively, it may be provided as an element separate from the printing head, and ink may be supplied to the printing head through a tube or the like.

Although applications of the invention to an ink container for supplying ink to a printing head have been described above, the invention may be applied to a supply section for supplying ink to a pen as a printing section.

In addition to various types of printing apparatus as thus described, the invention has a wide range of applications including apparatus for supplying various liquids such as drinking water and liquid flavoring materials and applications in the medical field for supplying pharmaceuticals.

As described above, according to the invention, a negative pressure in a liquid container can be kept substantially constant to consume the liquid (e.g., ink) therein completely, and no leakage of ink occurs because introduction of air for keeping the negative pressure in the liquid container at an adequate value is performed in an appropriate position. Since air is introduced in a region in a gaseous phase in the liquid container instead of being introduced through the ink, the introduction of air can be carried out reliably, and no air bubble is generated in the ink. Further, since an internal negative pressure generating mechanism is controlled by a member having an expanding or contracting force, it is possible to absorb any expansion of air introduced in the liquid container attributable to a change in the environment of the liquid container such as a temperature rise or pressure reduction, which prevents undesirable leakage of the liquid. Thus, there will be no wasteful consumption of the liquid, which also contributes to a reduction in running cost. Furthermore, the above-described advantages can be achieved with a small number of components according to the invention. In addition, when used in an ink jet printing head, the invention makes it possible to always achieve stable ink ejecting characteristics, thereby contributing to stabilization and improvement of quality of printing.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A liquid container comprising:

a movable member which defines a space for containing liquid and which is displaced as said liquid is supplied to the outside;

a liquid containing chamber having a liquid supply port for supplying the contained liquid to the outside;

a one-way valve for allowing gas to be introduced into said containing space from the outside and for preventing said liquid from being delivered from said containing space to the outside; and an introduction channel for coupling said one-way valve and said containing space to guide the introduced gas into said containing space, wherein an intake port of said introduction channel located on the side of said containing space is positioned in an upper part of said containing space in an orientation in use; and wherein at least part of said introduction channel including said intake port can follow up the displacement of said movable member.

2. A liquid container as claimed in claim 1, wherein said at least part of said introduction channel comprises a flexible tube.

3. A liquid container as claimed in claim 1, wherein said intake port is located in a position higher than the level of the liquid contained in said containing space in the orientation in use.

4. A liquid container as claimed in claim 1, wherein a hydrophobic gas-permeable film is disposed at said intake port.

5. A liquid container as claimed in claim 1, wherein a liquid absorbing member is disposed in said introduction channel.

6. A liquid container as claimed in claim 5, wherein said liquid absorbing member comprises a porous body.

7. A liquid-using apparatus which can be connected to a liquid container as claimed in claim 1 and which uses a liquid supplied from said containing space.

8. A liquid container as claimed in claim 1, wherein ink as a printing material is contained as said liquid.

9. An ink jet printing apparatus, wherein a liquid container as claimed in claim 8 and a printing head for ejecting ink supplied from said container are used to perform printing.

10. An ink jet cartridge comprising:

a liquid container as claimed in claim 8; and a printing head for ejecting ink supplied from said container.

11. A liquid container as claimed in claim 1, wherein said one-way valve has a blocking member capable of blocking out the atmosphere from said introduction channel which leads to said containing space and an urging member which generates an urging force rendering said blocking out, and, when a pressure within said containing space becomes less than a predetermined value, said introduction channel opens so as to communicate with the atmosphere against the urging force of said urging member.

* * * * *

UNITED STATES PATENT AND TRADEMARK OFFICE

CERTIFICATE OF CORRECTION

PATENT NO. : 6,976,753 B2
APPLICATION NO. : 10/726502
DATED : December 20, 2005
INVENTOR(S) : Nobuyuki Kuwabara et al.

It is certified that error appears in the above-identified patent and that said Letters Patent is hereby corrected as shown below:

Title page,
Item [30], Foreign Application Priority Data, "Dec. 10, 1905" should read -- Dec. 10, 2002 --.

Column 1,
Line 61, "in therein" should read -- ink therein --.

Column 3,
Line 25, "of" should read -- or --.

Column 5,
Line 64, "positioned" should read -- positioned at an --.

Column 8,
Line 59, "disposed" should read -- disposed at the --.

Column 10,
Line 53, "channel 151." should read -- channel 51. --.

Column 11,
Line 65, "the a" should read -- a --.

Column 14,
Line 42, "maybe" should read -- may be --.

UNITED STATES PATENT AND TRADEMARK OFFICE

CERTIFICATE OF CORRECTION

PATENT NO. : 6,976,753 B2
APPLICATION NO. : 10/726502
DATED : December 20, 2005
INVENTOR(S) : Nobuyuki Kuwabara et al.

It is certified that error appears in the above-identified patent and that said Letters Patent is hereby corrected as shown below:

Column 16,
Line 2, “are” should read -- is --.

Signed and Sealed this

Twenty-seventh Day of June, 2006

JON W. DUDAS
*Director of the United States Patent and Trademark Office*